US011682258B2

(12) United States Patent
Törnqvist

(10) Patent No.: US 11,682,258 B2
(45) Date of Patent: Jun. 20, 2023

(54) GAMING MACHINE INCLUDING SEPARATE FIRST AND SECOND USER INTERFACES

(71) Applicant: Play'n Go Marks Ltd, Sliema (MT)

(72) Inventor: Johan Törnqvist, Sliema (MT)

(73) Assignee: Play'n Go Marks Ltd, Sliema (MT)

( * ) Notice: Subject to any disclaimer, the term of this patent is extended or adjusted under 35 U.S.C. 154(b) by 72 days.

(21) Appl. No.: 17/160,625

(22) Filed: Jan. 28, 2021

(65) Prior Publication Data

US 2021/0241573 A1 Aug. 5, 2021

(30) Foreign Application Priority Data

Jan. 31, 2020 (SE) ..... 2050098-9

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... A63F 7/025; A63F 7/027; G07F 17/34
See application file for complete search history.

(56) References Cited

U.S. PATENT DOCUMENTS 6,646,695 B1 11/2003 Gauselmann
D525,313 S * 7/2006 Dattl ..... D21/325
7,780,534 B2 8/2010 Wudtke
8,764,573 B2 7/2014 Johnson et al.
2013/0228970 A1* 9/2013 Stellenberg ..... A63F 7/027 273/121 A
2013/0324237 A1* 12/2013 Adiraju ..... G07F 17/3237 463/29
2014/0228096 A1 8/2014 Detlefsen et al.
2014/0376182 A1* 12/2014 Motoishi ..... G06F 1/1632 361/679.55
2016/0093143 A1 3/2016 Lamb et al.

FOREIGN PATENT DOCUMENTS

DE 4211311 A1 10/1993
EP 1686549 A1 8/2006
EP 2453422 A1 5/2012
WO WO-03086560 A1 * 10/2003 ..... A63F 13/005
WO 2004101087 A2 11/2004

OTHER PUBLICATIONS

Swedish Search Report dated Oct. 16, 2020 for Swedish Patent Application No. 2050098-9, 2 pages.
Extended European Search Report dated Jun. 16, 2021 for EP Application No. 21153807.9, 6 pages.

* cited by examiner

*Primary Examiner* — Robert T Clarke, Jr.
(74) *Attorney, Agent, or Firm* — RMCK Law Group, PLC

(57) ABSTRACT

The present invention generally relates to a gaming machine, and specifically to a gaming machine provided with a novel arrangement for controlling its operation, for example including a first and a second user interface.

16 Claims, 2 Drawing Sheets

GAMING MACHINE INCLUDING SEPARATE FIRST AND SECOND USER INTERFACES

CROSS-REFERENCE TO RELATED APPLICATIONS

This application claims priority to Swedish Patent Application No. 2050098-9, filed on Jan. 31, 2020. The disclosure of the above application is hereby incorporated by reference in its entirety.

TECHNICAL FIELD

The present invention generally relates to a gaming machine, and specifically to a gaming machine provided with a novel arrangement for controlling its operation, for example including a first and a second user interface.

BACKGROUND

Games of chance are known and widely played for recreational purposes. The gaming industry has come to recognize that to sustain long term success it must be constantly innovative in introducing new games and new gambling concepts to the gaming public. Recently, an increased amount of the gaming is involving a gaming software adapted to be executed at an electronic device of an end used, such as at a computer, a table or a mobile phone.

However, dedicated gaming machine will generally provide a further level of entertainment for the user, since the hardware possibly may be targeted towards specific options of the game itself. Such gaming machines may for example providing games such as electronically driven video slots, video poker, video blackjack, video keno, video bingo, video pachinko, video lottery, and mechanically driven reel slots, etc., all being well known in the gaming industry. Generally, video gaming machines are configured with a main video display for displaying video game images including video images representing game play outcome (e.g., simulated reel symbols in the case of a slot game, simulated cards, simulated numbers, etc.). Mechanical spinning reel slot machines, on the other hand, generally include a main reel display area configured to allow a player to view a reel symbol array provided by the stopped mechanical spinning reels.

Generally, the popularity of such gaming machines is dependent on the likelihood (or perceived likelihood) of winning money at the machine and the intrinsic entertainment value of the machine, for example including the look-and-feel of the machine when interacting with the machine. The payback percentage that each gaming machine is programmed to provide is tightly controlled by regulatory authorities. Consequently, often the only distinguishing feature between gaming machines is the entertainment value they provide. Gaming establishments strive to place the most entertaining gaming machines on their casino floors to attract players and increase profitability.

Providing an attractive interaction with the gaming machine is one of the most effective methods for increasing player entertainment value. Accordingly, there is an ongoing desire to provide improvements of such gaming machines for retaining end users at the gaming machine for a prolonged duration. To ensure that this is possible, it is desirable to ensure that the gaming environment is physically suitable for the end user, thus generally providing a desirable ergonomic environment for the end user when playing the game.

SUMMARY

According to an aspect of the invention, the above is at least partly alleviated by a gaming machine, comprising a display screen adapted to display a graphical user interface (GUI), a housing, a first user interface to be operated by a user of the gaming machine for operating a first portion of the GUI, and a control unit, the control unit connected to the display and the user interface, wherein the housing comprises a top side, a bottom side, a front side, a back side, a left side and a right side, the housing arranged to receive the display at the front side, the first user interface is separate from the display screen and comprises a first and the second game control, the first and the second game control is arranged at the left and the right side of the housing, respectively, and the control unit is adapted to control the first portion of the GUI of the display screen based on user interaction with the first and the second game control.

By means of the invention, the user will be provided with a novel way of interacting with the first portion of the GUI, the first portion of the GUI typically comprising the area where the user is to interact when playing a game. In comparison, in prior art solutions, the user will typically interact with the first portion of the GUI using a touch screen integrated with the display screen showing the first portion of the GUI or using buttons arranged directly adjacently and facing towards the user in the same direction as the display screen.

An advantage following the preset disclosure it that the user may achieve a higher level of relaxation when playing the game using the gaming machine according to the present disclosure. That is, rather than having to "lean over" the gaming machine as is necessary using prior-art gaming machines (which generally is the case when the display screen is larger than 20 inches), the user may when using the gaming machine defined in line with the present disclosure arrange his arms and hands along the left—and right-hand side of the gaming machine for interacting with the respective game controls. Accordingly, the ergonomics in using the gaming machine in line with the present disclosure is superior as compared to e.g. a typical slot machine as is provided in a general gaming establishment.

Furthermore, by arranging the first and the second game control at the left and the right side of the housing of the gaming machine, the user is not cluttering and/or cover the display screen with its fingers/hands/arms, since the fingers/hands/arms instead will be positioned at the sides of the gaming machine. Accordingly, the GUI of the game may be correspondingly adapted, whereby the user can be provided with an increase display area (as compared to prior art solutions) for showing the game.

In accordance to the present disclosure, the expression "control unit" should be understood to include any type of computing device, such as an ASIC, a micro-processor, etc. It should also be understood that the actual implementation of such a processing circuitry may be divided between more than a single device/circuit.

Similarly, the expression "game control" should be interpreted broadly and may include any form of e.g. button or similar that may be used for allowing the user to interact with information about a game, defined as gaming information, preferably being displayed within the first portion of the GUI. As an example, the game may be a slot game, a card game, or a terminal game. Other type of games may of course be possible and are within the scope of the present disclosure. In some embodiments the first and the second game control may be provided with haptic feedback.

It should however be understood that e.g. at least one of the game controls arranged at the respective left- and right-hand side of the gaming machine possibly could be implemented using touch technology or similar. Accordingly, the user must not necessarily "press down" a physical button for interacting with the first portion of the GUI.

To further improve the user interaction with the gaming machine according to the present disclosure, and for possibly also further improve the ergonomic of the gaming machine, it may be preferred to arrange the first and the second game control at a bottom portion of the left and the right side of the housing, respectively, in a vicinity of the bottom side of the housing. Each of the sides defined in relation to the gaming machine should be seen in relation to a user facing the machine.

As such, the user will typically be standing or sitting in front of the gaming machine and thus facing the front side of the gaming machine. It is generally desirable that the overall gaming machine is arranged in an inclined manner in front of the user, whereby the bottom side of the gaming machine (overall) will be facing towards e.g. a floor within the gaming establishment where the gaming machine is arranged.

In addition to the above discussion, it may in some embodiments be desirable to arrange the display screen to at least partly function as a touch screen, where the touch screen is adapted to provide a second user interface for operating a second portion of the GUI. In some embodiments, it may be suitable to allow the second portion of the GUI to be at least partly separate from the first portion of the GUI. Possibly, in an embodiment where the first portion of the GUI is used for presenting a game to be interacted with by the user using the side arranged game controls, the second portion of the GUI could be used for e.g. betting, payment, etc., in relation to the overall use of the gaming machine.

In some embodiments of the present disclosure the first portion of the GUI is only controllable using the first and the second game control. Accordingly, in such an implementation the first and the second game control is used for playing the game, and e.g. the touch screen is used for controlling e.g. betting, etc. in relation to the game.

In some embodiments the housing comprises an extension, the extension arranged at the bottom side of the housing. The extension may in some embodiments be adjustable in relation to the housing. Accordingly, a level of inclination of the extension may possibly adjusted by the user when operating the gaming machine for further improve the ease of interaction with the gaming machine. In some embodiments the gaming machine is arranged to allow inclination levels of both the housing and extension to be adjusted.

Preferably, the first and the second game control are comprised with the extension. Accordingly, by allowing the extension to be inclined in relation to the housing, the user may be provided with a superior overview of the display screen while at the same time easily interact with the game controls, without having to stretch hands/arms in an unnatural way. Possibly, the extension may extend along the complete bottom portion of the housing.

It is desirable to allow the gaming machine to further comprise a mounting structure configured to receive the housing. The mounting structure may for example be arranged to comprise means for allowing a level of inclination of the housing. That is, in some embodiments a level of inclination (or tilt angle) may be adjusted between two end points, where the first end point may allow the housing to be arranged towards being arranged in a fully vertical manner, and the second end point may allow the housing to be arranged towards being arranged in a fully horizontal manner. In some embodiments the level of inclination could possible be adjusted 5-30 degrees. Allowing such an adjustment of inclination may allow persons of different heights to fully interact with the gaming machine. The mounting structure may possibly comprise at least one of a wall-mount and a floor stand.

The gaming machine may further comprise a third user interface for receiving a payment from the user. Such a payment feature may for example be implemented using e.g. an RFID or NFC reader, or any other present or future technology that may be used for e.g. communication with payment means, such as a credit card. However, it should be understood that also other means for payment is possible and within the scope of the present disclosure.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawing, in which.

DETAILED DESCRIPTION

Figure 1A:
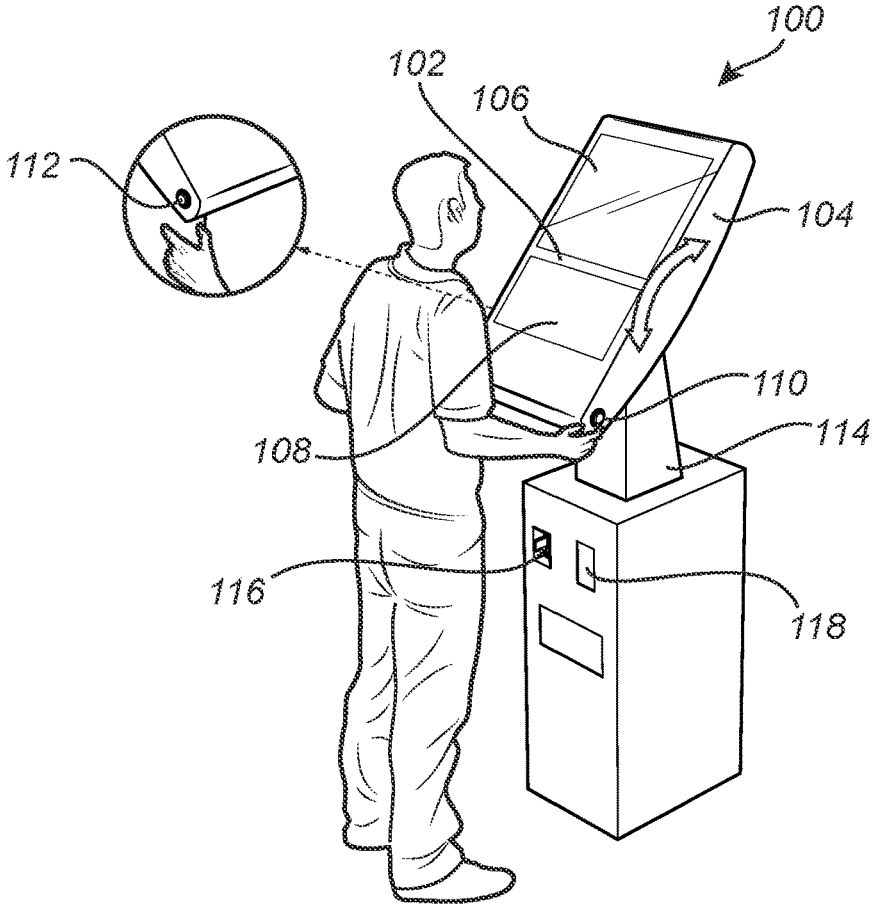
FIGS. 1A and 1B illustrate perspective views of different embodiment of gaming machine according to the present disclosure, and FIG. 2 provides detailed information relating to an extension provided in relation to the gaming machine for further facilitating user interaction with a game to be played at the gaming machine.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1A in particular, there is depicted a gaming machine 100, typically arranged at a floor level of a gaming establishment, such as e.g. a casino or similar. The gaming machine 100 comprises a display screen 102 adapted to display a graphical user interface (GUI) as well as a housing 104. The gaming machine 100 is here seen as arranged in a slightly inclined manner, meaning that the gaming machine 100 is not completely vertically arranged, but rather slightly inclined to be slightly slanted in a direction towards being horizontally arranged. The housing 104 comprises a top side, a bottom side, a front side, a back side, a left side and a right side. The display screen 102 is arranged at the front side of the housing 102.

The gaming machine 100 further comprises a first user interface to be operated by a user of the gaming machine 100 for interacting with a game that is shown at the display screen 102. Specifically, the GUI shown at the display screen is divided into a first portion 106 and a second portion 108. Generally, the first portion 106 of the GUI is used for displaying gaming information that the user is interacting with when playing a game, such as to execute actions within the game. The second portion 108 of the GUI may also present information relating to the game. However, generally the second portion 108 of the GUI will typically be used for e.g. placing bets, etc., in relation to the game. In FIG. 1A the first portion 106 is shown above the second portion 108. It may of course be possible to allow the second portion 108 to be arranged above the first portion 106. Also, the first 106 and the second 108 may in some embodiments slightly overlap. In some embodiments the overlap is less than 25%.

It is in line with the present disclosure desirable to arrange the first user interface separate from the display screen 102. According to the present disclosure, the first user interface comprises a first and a second game control 110, 112.

In some embodiments of the present disclosure the gaming machine 100 further comprises a second user interface, such as for example a touch screen interface arranged in relation to the second portion 108 of the GUI. Accordingly, the second user interface is solely used for e.g. placing bets, payments, etc., and not for execute actions within the game that is displayed within the first portion 106 of the GUI shown at the display screen 102.

The display screen 102 may in some embodiments have a screen size exceeding 25 inches, such as from 25-50 inches (or larger), as seen from a diagonal measurement. Other sizes are of course possible and within the scope of the present disclosure. In some embodiments the display screen 102 may be slightly curved, as seen from the top to the bottom side (i.e. with a "local minima" between the top and the bottom side).

The gaming machine 100 further comprises a control unit (not explicitly shown), where the control unit connected to the display and the first and the second user interface. For reference, the control unit may be manifested as a general-purpose processor, an application specific processor, a circuit containing processing components, a group of distributed processing components, a group of distributed computers configured for processing, a field programmable gate array (FPGA), etc. The processor may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein.

In line with the present disclosure the first game control is arranged at the right-hand side of the gaming machine 100, and the second game control 112 is arranged at the left-hand side of the gaming machine 100. Each of the first and the second game control 110, 112 may in some embodiments comprise a single button to be pushed by the user when playing the game for executing different actions within the game that is displayed within the first portion 106 of the GUI. However, each of the first and the second game control 110, 112 may as an alternative comprise more than a single button, such as two, three, four buttons (etc.), where each of the buttons pushed separately or in combination may be used for executing different actions within the game that is displayed within the first portion 106 of the GUI.

As indicated above, the technology used for implementing the button(s) of the first and the second game control 110, 112 may include general push buttons, touch technology buttons, or any other form of known of future suitable technique for allowing the user to interact with the game.

Furthermore, in the exemplary illustration as shown in FIG. 1A, the gaming machine 100 further comprises a stand 114 for allowing the gaming machine 100 to be positioned at a floor of e.g. the mentioned gaming establishment. The stand 114 may in some embodiments comprise means for allowing the user to make payments, such as using a card reader 116 implemented using any suitable technology. The stand 114 may also optionally comprise means for allowing the user to receive payments, such as a e.g. a printer or a cash payment arrangement 118.

It should be understood that e.g. the card reader 116 as well as optionally the cash payment arrangement 118 could be comprised with the housing 104.

Additionally, the gaming machine 100 may in some embodiments be connected to a remotely located server (not shown), that may be used for handling reception of and provision of payment(s) from/to the user. Such a remotely arranged server could also, at least in part, be used for administrating the general operation of the gaming machine 100.

Figure 1B:
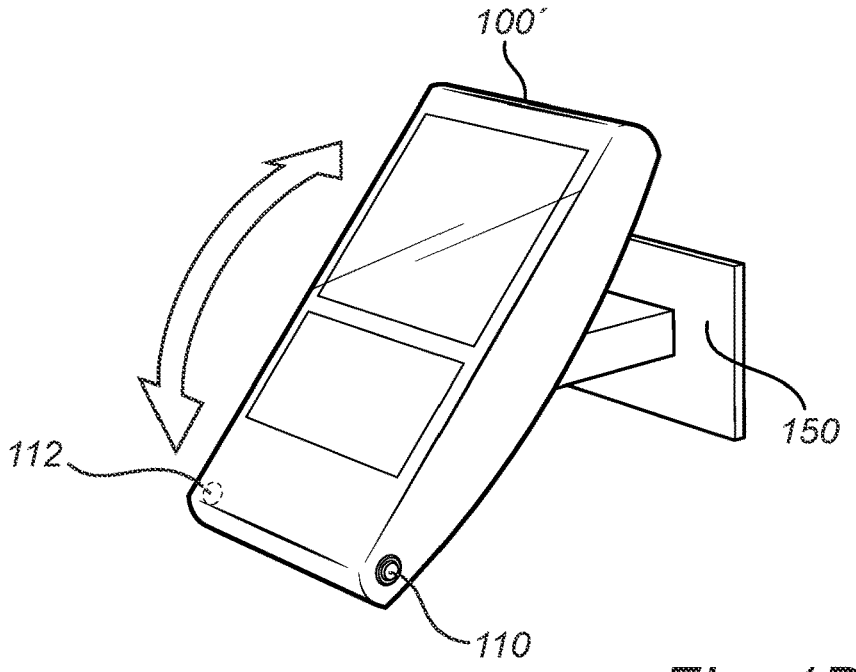

FIG. 1B presents an alternative implementation of a gaming machine 100', according to an embodiment of the present disclosure. The gaming machine 100' in essence corresponds to the gaming machine 100 as shown in FIG. 1A. However, in the exemplary illustration as shown in FIG. 1B, the gaming machine 100' is shown as "wall-mounted". Accordingly, in such an embodiment a bracket 150 is instead used, i.e. as compared to the stand 114 as shown in FIG. 1A.

The bracket 150 (as well as the wall stand 114) may include means for allowing the housing 104 to be inclined as discussed above. Preferably, such inclination means is preferably adapted to allow at least an inclination level to be adjusted within a predetermined range. Such a predetermined range may for example be between 5-30 degree. As such, players of different lengths may swiftly adjust the inclination to best suit an ergonomic "gaming position" for the user. Also, allowing the inclination level to be adjusted may also allow the gaming machine 100 to be used when the user is standing or sitting at e.g. a tall padded stool as is frequently used in gaming establishments.

Figure 2:
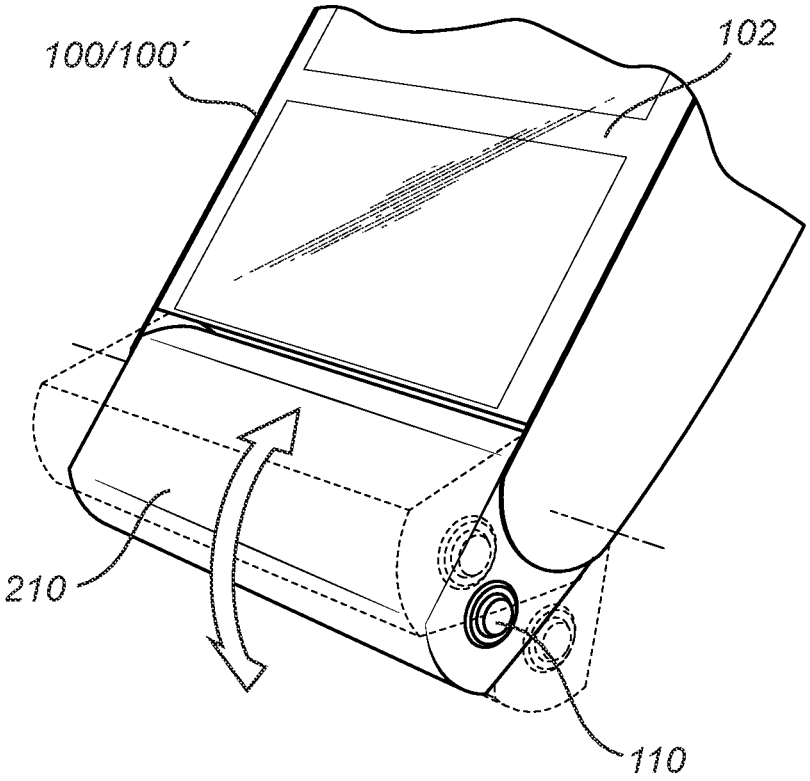

Turning now to FIG. 2, there is shown a still further embodiment of the present disclosure. Specifically, in FIG. 2 the gaming machine 100/100' has been provided with an extension 210, arranged at the bottom end of the housing. As shown in FIG. 2, it may be desirable to allow the first and a second game control 110, 112 to be integrated with the extension 210. In some embodiments the extension 210 comprises a hand rest portion (not shown).

In line with the present disclosure, also the extension may optionally be provided with means for allowing the extension to be inclined. Such means may for example include some form of "controllable hinge" that allows the extension to stay at an inclination selected by the user.

During operation of the gaming machine 100/100', the user will typically position himself in front of the gaming machine 100/100'. The gaming machine 100/100' may optionally comprise means for detecting when a potential user has positioned himself at the gaming machine 100/100' with the intention to play a game. Such detection means may for example me implemented using infrared and/or microwave technology. It may of course be possible to simply push a button at the gaming machine 100/100' for starting interaction with the gaming machine 100/100'.

Once the gaming machine 100/100' has been activated, the display screen 102 will display information to the user requesting the user to make some form of payment to be able to start playing a game. As mentioned above, e.g. the card reader 116 may be used for receiving a payment from the user.

In some embodiments, the second portion 108 of the GUI displayed at the display screen 102 is used for receiving a bet from the user. Following placement of the bet, the first portion 106 of the GUI will start showing the game to be played by the user. Any form of games may be operated within at least the first portion 106 of the GUI, e.g. being one of a slot game, a card game, or a terminal game. It could also be possible to participate in an online game where other users are involved, where possibly the other users may be located at the same gaming establishment, at another gaming establishment, or even in another country.

When playing the game and for performing actions within the game, the user will make use of the first and a second game control 110, 112. The first and a second game control 110, 112 may for example be used for advancing within the game, for selecting bonus features within the game, etc. There is essentially no limitation to what may be controlled within the game using the first and a second game control 110, 112.

Generally, the user will continuously be allowed to adapt the inclination of the housing 104 as well as optionally the inclination of the extension 210.

In addition, the control functionality of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium.

Combinations of the above are also included within the scope of machine-readable media. Machine-executable instructions include, for example, instructions and data which cause a general-purpose computer, special purpose computer, or special purpose processing machines to perform a certain function or group of functions.

Although the figures may show a sequence the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art. Further, a single unit may perform the functions of several means recited in the claims. In the claims, any reference signs placed between parentheses shall not be construed as limiting to the claim. Furthermore, in the claims, the word "comprising" does not exclude other elements or steps, and the indefinite article "a" or "an" does not exclude a plurality.

Variations to the disclosed embodiments can be understood and effected by the skilled addressee in practicing the claimed invention, from a study of the drawings, the disclosure, and the appended claims. The person skilled in the art realizes that the present invention is not limited to the preferred embodiments.

What is claimed is:

1. A gaming machine, comprising:

a display screen adapted to display a graphical user interface (GUI), wherein at least a portion of the display screen comprises a touch screen, a housing, a mounting structure configured to receive the housing, a first user interface to be operated by a user of the gaming machine for operating a first portion of the GUI, and a control unit, the control unit connected to the display and the first user interface, wherein:

the mounting structure is arranged to allow for a change in a tilt angle of the housing in relation to the user of the gaming machine, the touch screen is adapted to provide a second user interface for operating a second portion of the GUI, the housing comprises a top side, a bottom side, a front side, a back side, a left side and a right side, the housing arranged to receive the display at the front side, the first user interface is separate from the display screen and comprises a first and a second game control, the first and the second game controls are arranged at the left and the right side of the housing, respectively, the GUI presents gaming information to the user within the first portion of the GUI, the control unit is adapted to control the first portion of the GUI only based on user interaction with the first and the second game control, and the second portion of the GUI is separate from the first portion of the GUI.

2. The gaming machine according to claim 1, wherein the first and the second game control is arranged at a bottom portion of the left and the right side of the housing, respectively, in a vicinity of the bottom side of the housing.

3. The gaming machine according to claim 1, wherein the first and the second game control are each provided with at least one button.

4. The gaming machine according to claim 1, wherein the housing comprises an extension, the extension arranged at the bottom side of the housing.

5. The gaming machine according to claim 4, wherein the first and the second game control are comprised with the extension.

6. The gaming machine according to claim 4, wherein the extension is extending along the complete bottom portion of the housing.

7. The gaming machine according to claim 1, wherein the mounting structure comprises at least one of a wall-mount and a floor stand.

8. The gaming machine according to claim 1, further comprising a third user interface receiving a payment from the user.

9. The gaming machine according to claim 8, wherein the third user interface comprises an RFID reader or an NFC reader.

10. The gaming machine according to claim 1, wherein the gaming information comprises a game to be played by the user.

11. The gaming machine according to claim 10, wherein the game is a slot game, a card game, or a terminal game.

12. A gaming machine, comprising:

a display screen adapted to display a graphical user interface (GUI), wherein at least a portion of the display screen comprises a touch screen, a housing, a mounting structure configured to receive the housing, a first user interface to be operated by a user of the gaming machine for operating a first portion of the GUI, and a control unit, the control unit connected to the display and the first user interface, wherein:

the mounting structure is arranged to allow for a change in a tilt angle of the housing in relation to the user of the gaming machine, the touch screen is adapted to provide a second user interface for operating a second portion of the GUI, the housing comprises a top side, a bottom side, a front side, a back side, a left side and a right side, the housing arranged to receive the display at the front side, the first user interface is separate from the display screen and comprises a first and a second game control, the first and the second game controls being arranged at the left and the right side of the housing, respectively, the GUI presents gaming information to the user within the first portion of the GUI, the control unit is adapted to: (i) control the first portion of the GUI only based on user interaction with the first and the second game control, and (ii) control the second portion of the GUI only based on user interaction with the touch screen, and the second portion of the GUI is separate from the first portion of the GUI.

13. The gaming machine according to claim 12, wherein the housing comprises an extension, the extension arranged at the bottom side of the housing, wherein the first and the second game control are comprised with the extension, and wherein the extension is extending along the complete bottom portion of the housing.

14. The gaming machine according to claim 12, wherein the mounting structure comprises at least one of a wall-mount and a floor stand.

15. The gaming machine according to claim 12, further comprising a third user interface receiving a payment from the user.

16. The gaming machine according to claim 15, wherein the third user interface comprises an RFID reader or an NFC reader.

* * * * *